US007059315B2

(12) United States Patent
Blahnik

(10) Patent No.: US 7,059,315 B2
(45) Date of Patent: Jun. 13, 2006

(54) COMPOUND BOW WITH ADJUSTABLE LET-OFF

(76) Inventor: Roger C. Blahnik, W. 1696 County Rd. 374, Carney, MI (US) 49812

( * ) Notice: Subject to any disclaimer, the term of this patent is extended or adjusted under 35 U.S.C. 154(b) by 35 days.

(21) Appl. No.: 10/189,071

(22) Filed: Jul. 2, 2002

(65) Prior Publication Data

US 2004/0003806 A1 Jan. 8, 2004

(51) Int. Cl.
*F41B 5/10* (2006.01)

(52) U.S. Cl. ..... 124/25.6

(58) Field of Classification Search ..... 124/25.6, 124/900

See application file for complete search history.

(56) References Cited

U.S. PATENT DOCUMENTS 5,368,006 A * 11/1994 McPherson ..... 124/25.6
5,975,067 A * 11/1999 Strother ..... 124/25.6
6,082,346 A * 7/2000 Andrews et al. ..... 124/25.6
6,250,293 B1 * 6/2001 Andrews ..... 124/25.6

* cited by examiner

*Primary Examiner*—John A. Ricci
(74) *Attorney, Agent, or Firm*—Richard K. Thomson

(57) ABSTRACT

A compound bow includes a cam configuration permitting the force line of the harness cable to effectively act through a portion of the axle pin. This permits, in this bow design, 100% let-off. An adjustable bushing or a modular cam portion enables the archer to adjust the let-off in a range of between 85% and 99+%. Single and double cam bows are disclosed.

24 Claims, 12 Drawing Sheets

COMPOUND BOW WITH ADJUSTABLE LET-OFF

BACKGROUND AND SUMMARY OF THE INVENTION

The present invention is directed to a compound bow that is capable of 100% let-off, a cam which permits 100% let-off, and an adjustable deflector to adjust the actual let-off to an archer-determined level.

Compound bows are used in both competitive archery and hunting small and large game. Modern day bows can require significant amounts of force to retract the nocked arrow to full draw. It then becomes problematic to retain the arrow in the firing position since holding against 50–100 pounds of force for any length of time will produce muscle fatigue which can influence the accuracy of the shot. In order to reduce the strain, some archers will pull the bow to less draw weight which negatively affects arrow speed that in turn reduces distance, target penetration and arrow trajectory.

In order to cope with this problem, some of today's compound bow systems have taken one of two approaches: 1) employment of a locking system that will hold the nocked arrow at full draw; or, 2) using a cam system which permits a reduction in the holding force, commonly known as let-off. The current systems have gradually moved the achievable let-off from 50% to as high, in some cases, as 85%. Even holding 15% of the draw force of a 100 pound bow (15 pounds) for extended periods of time in order to access a target, can produce muscle strain leading to an inaccurate shot.

It is an object of the present invention to provide a compound bow that is capable of 100% let-off. Hence, the bow may be adjusted to permit the bow to be held at full draw with as little as 0.001% of the draw force (0.1 pound for a 100 pound bow). With the present design, the archer can adjust the let-off to whatever level of let-off he or she desires in the range of between 85% and just under 100%. This means that the archer can hold the bow at full draw for extended periods of time without producing muscle fatigue that will negatively impact the shot. Accordingly, the nocked arrow can be drawn to firing position prior to the animal entering the shooting zone, reducing the risk of detection resulting from movement and/or sound.

The compound bow of the present invention comprises a riser; a limb connected to the riser; an eccentric cam mounted on the limb; a harness cable wrapped about at least a portion of said eccentric cam, the cable having a force line and requiring a particular level of draw force and retaining force; an axle pin mounting the cam to the limb and about which the cam rotates; means to permit the force line of the cable to effectively act through the axle pin enabling said cam to effect 100% let-off of said retaining force; means to adjust said retaining force to a user desired level less than 100% let-off. The means for permitting the force line of the cable to effectively act through the axle pin can include a notched axle pin, a two-piece axle pin, a deflector which adjusts the path of the cable to extend around the axle pin. With a single cam compound bow, an eccentric bushing may be employed to deflect the harness cable in a direction outwardly from the axle pin to produce an archer-selected level of let-off in the range of between 85% and 99+%. With a double cam bow, the level of let-off may be altered by replacing a modular tip of the cam to alter the amount of deflection of the harness cable and, hence, the amount of let-off.

It will be understood that a variety of different pivot means can be utilized with the cams of the present invention. While the term "pivot axle" has been utilized herein, it is intended that any and all such pivot means as may be substituted for the pivot pin shown herein be included in the scope of the present invention.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1A:
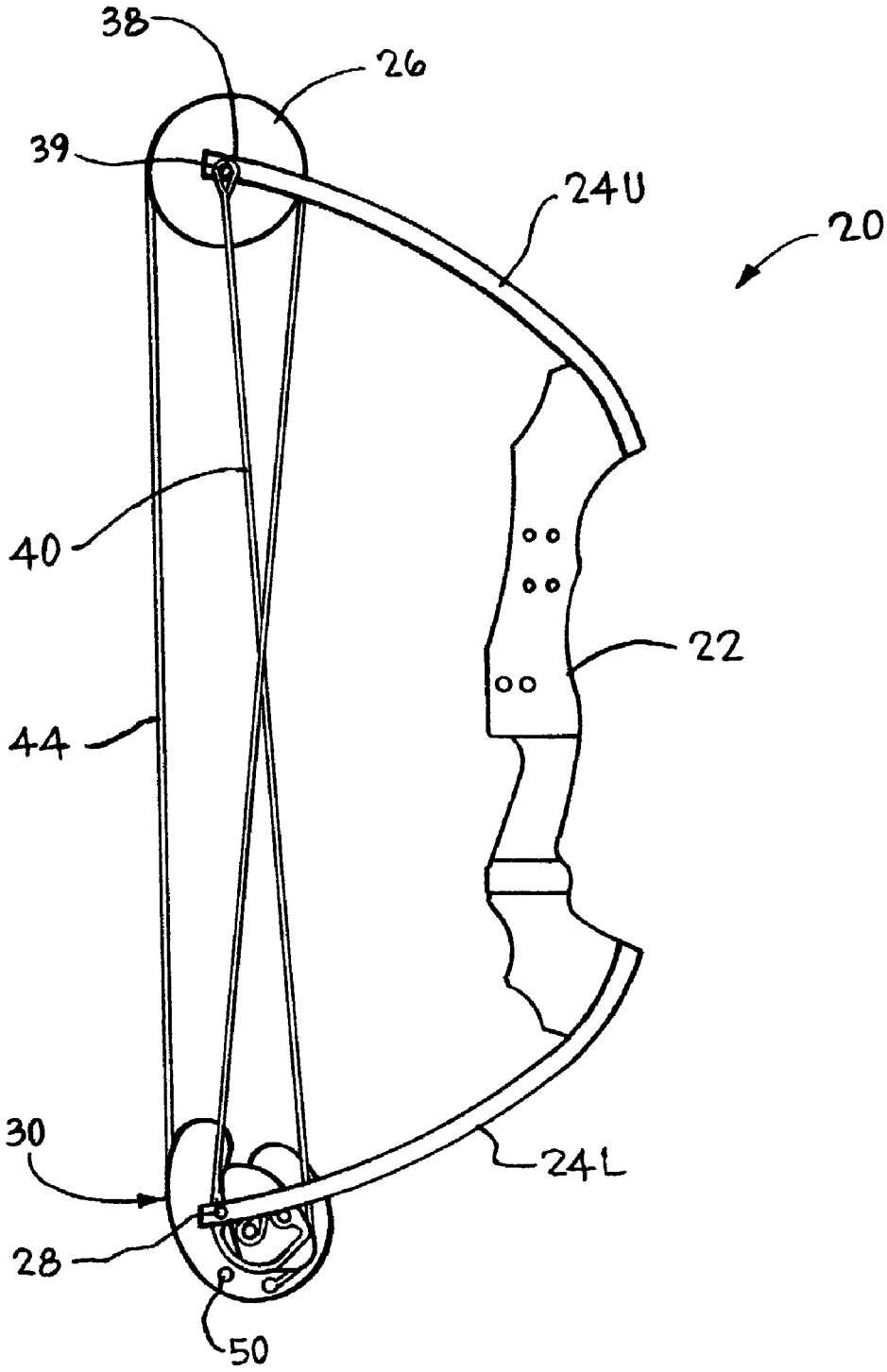
FIG. 1A is a side view of a first embodiment of the compound bow of the present invention shown in the brace height position.
Figure 1B:
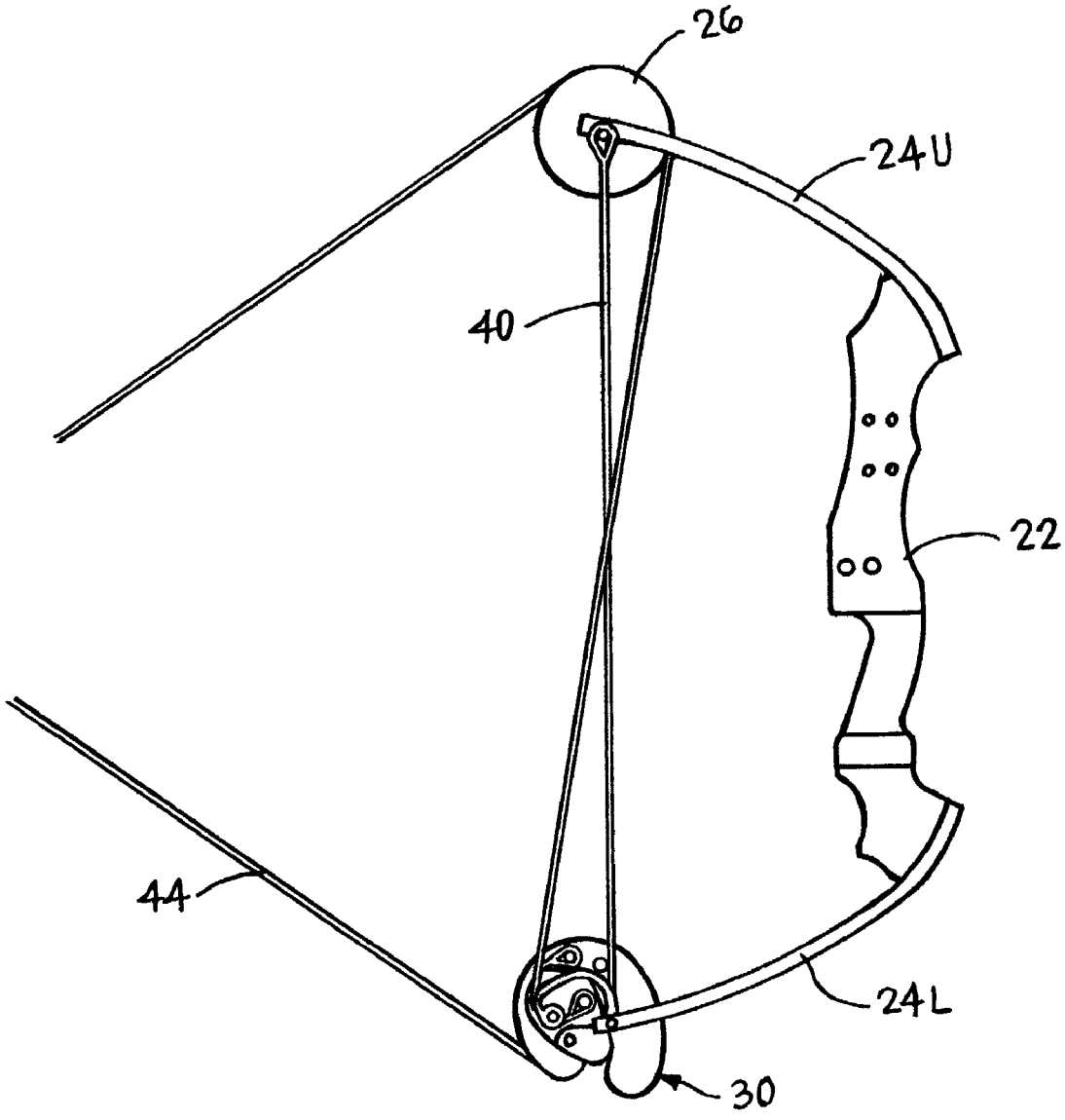
FIG. 1B is a side view of the first embodiment of the compound bow of the present invention shown at full draw.
Figure 1C:
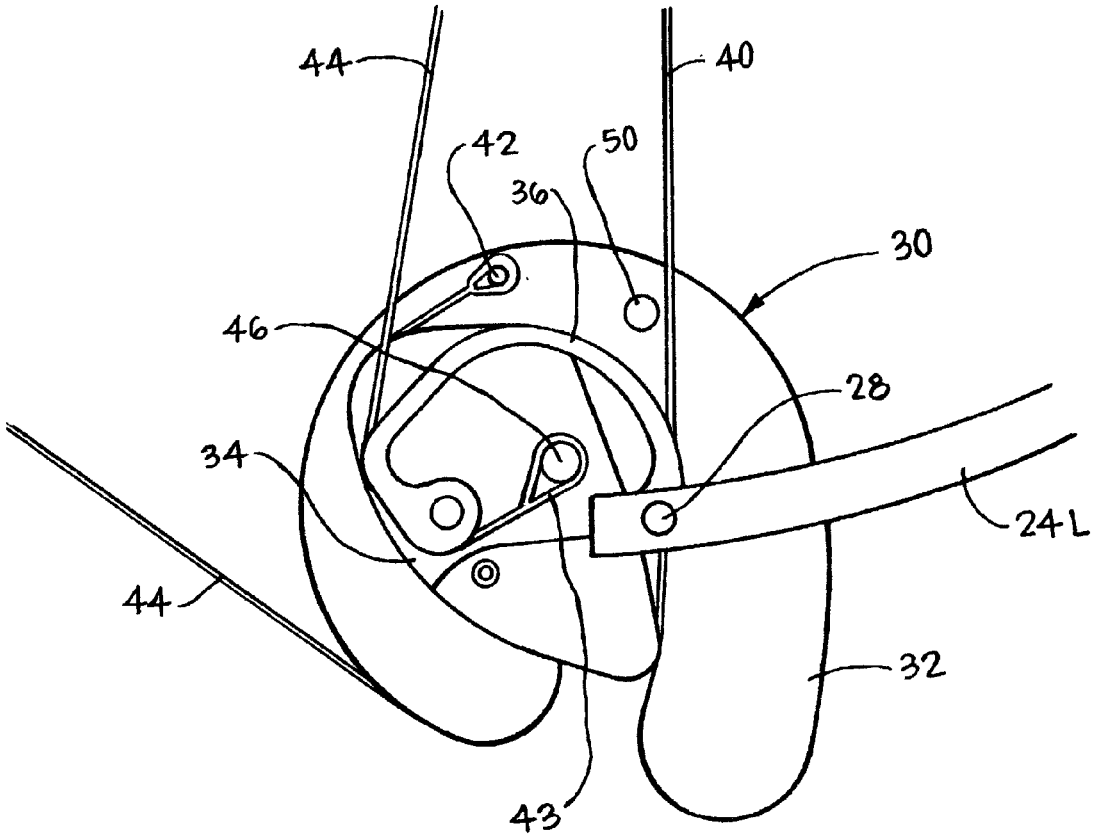
FIG. 1C is an enlarged detailed side view of the right-handed cam arrangement used with the first embodiment.
Figure 2A:
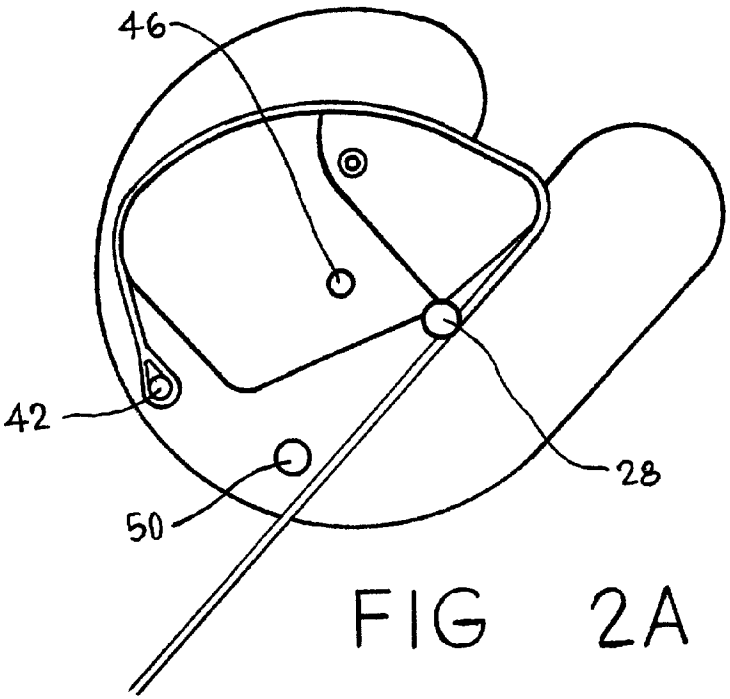
FIG. 2A is a side view of a second embodiment showing a left-handed cam arrangement with portions removed for clarity.

A first embodiment of the compound bow of the present invention is shown generally at 20 in FIGS. 1A and 1B. Compound bow 20 includes riser 22, limbs 24U and 24L, a pulley 26 rotatably mounted to limb 24U and an eccentric cam 30 rotatably mounted to lower limb 24L by axle pin 28. Cam 30 (FIG. 2C) has three levels, a first large diameter cam 32, a center cam 34, and an upper cam 36. As seen in FIG. 2C, the peripheries of cams 32, 34, 36 are grooved in a conventional manner to accommodate the cables which they contact. A first end 38 of harness string or cable 40 is anchored by pin 39 to upper limb 24U, is wound about center cam 34, and is anchored by post 42 (FIG. 1C) which projects upwardly from the surface of large cam 32. A first end 43 of draw string or cable 44 is anchored by post 46 which extends upwardly from center cam 34, extends around a portion of upper cam 36, pulley 26 and large cam 32, the other end of cable 44 being anchored on a post 48 (FIG. 2C) on the far side of large cam 32.

Post 48 is shown in ghost image within the plane of large cam 32 because typically post 48 will be one of a plurality of posts positioned in a hollowed out region of cam 32 (i.e., roughly ⅔ the thickness of the cam 32 is removed and the post 48 is attached in the recess). The use of a plurality of different attachment posts 48 permits the length of the cable (and, hence, the draw force) to be adjusted.

It is an important feature of this invention that the force line of cable 40 (i.e., the line along which the cable tension acts) effectively act through axle pin 28. It is the acting of the force line through axle pin 28 in this particular compound bow configuration, that permits 100% let-off to be achieved. There are a number of embodiments taught in this application which produce this result. The first such embodiment is shown in FIGS. 2A and 2B in which axle pin 28 has a groove 29 which receives cable 40. In FIG. 2A, the upper cam 36 has been omitted to better view the engagement of the cable 40 with axle pin 28. Of course, 100% would mean that the arrow would not fire when the archer released it. Accordingly, an eccentric bushing 50 is provided to engage cable 40 and deflect it outwardly to provide the archer with a let-off in a range of between 85% and 99+%, whatever level the archer desires. It will be appreciated that this 100% let-off feature is the equivalent of an over-center spring and, once the cable/nocked arrow is set in motion, the full thrust of the bow will be activated.

Figure 2D:
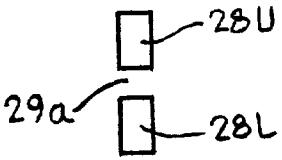
FIG. 2D is a detailed side view of a second version of the axle pin used with this second embodiment.
Figure 2C:
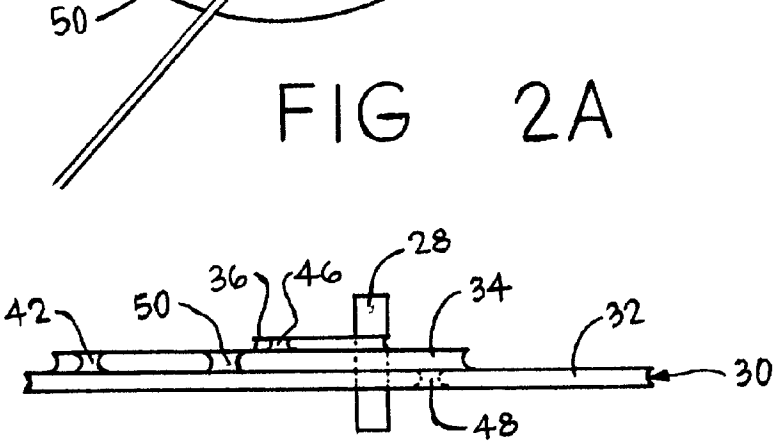
FIG. 2C is an edge view of the cam arrangement used with this second embodiment.
Figure 2B:
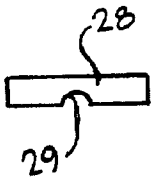
FIG. 2B is a detailed side view of a first version of the axle pin used with this second embodiment.

A second embodiment of the axle pin used in the compound bow of the present invention is shown in FIG. 2D. In this embodiment, axle pin is bifurcated into upper pin 28U and lower pin 28L forming a space 29*a* for receiving cable 40. Lower pin 28L will pivotally mount large cam 32 and upper axle pin 28U will pivotally mount center cam 34 and upper cam 36.

Figure 3A:
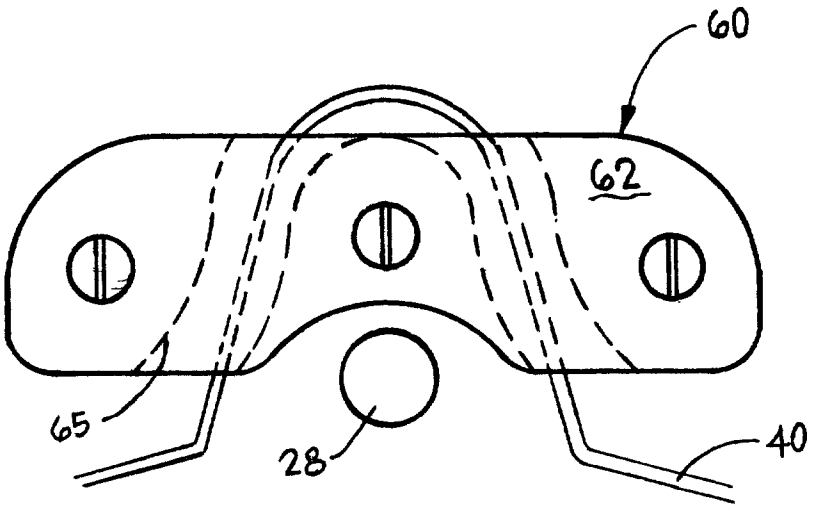
FIG. 3A is a detailed side view of the second level of a third embodiment of the cam arrangement which may be used with the compound bow of this present invention.
Figure 3B:
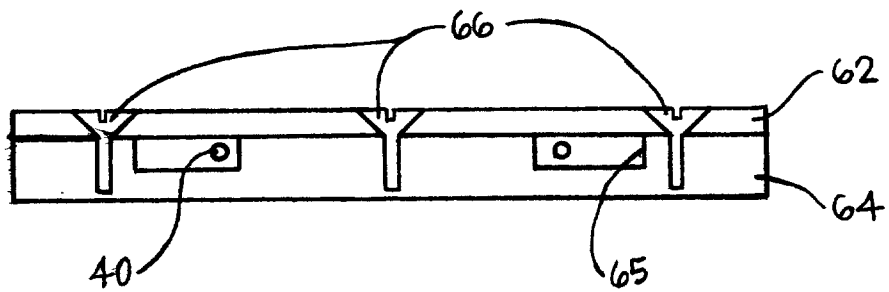
FIG. 3B is an edge view of the second level shown in FIG. 3A.

An alternate approach to achieving the force line effectively acting through the axle pin 28 is to deflect the cable 40 around the pin 28. Four embodiments of this approach are depicted in FIGS. 3-6. The third embodiment of the present invention is shown in FIGS. 3A and 3B generally at 60. Deflector 60 has a body portion 64 and a removable cap 62 attached by fasteners 66 that permit the cap to be removed to allow cable 40 to be inserted into channel 65. Channel 65 deflects cable 40 in a path around axle pin 28 and allows the force line of cable 40 to effectively pass through the axle pin 28.

Figure 4:
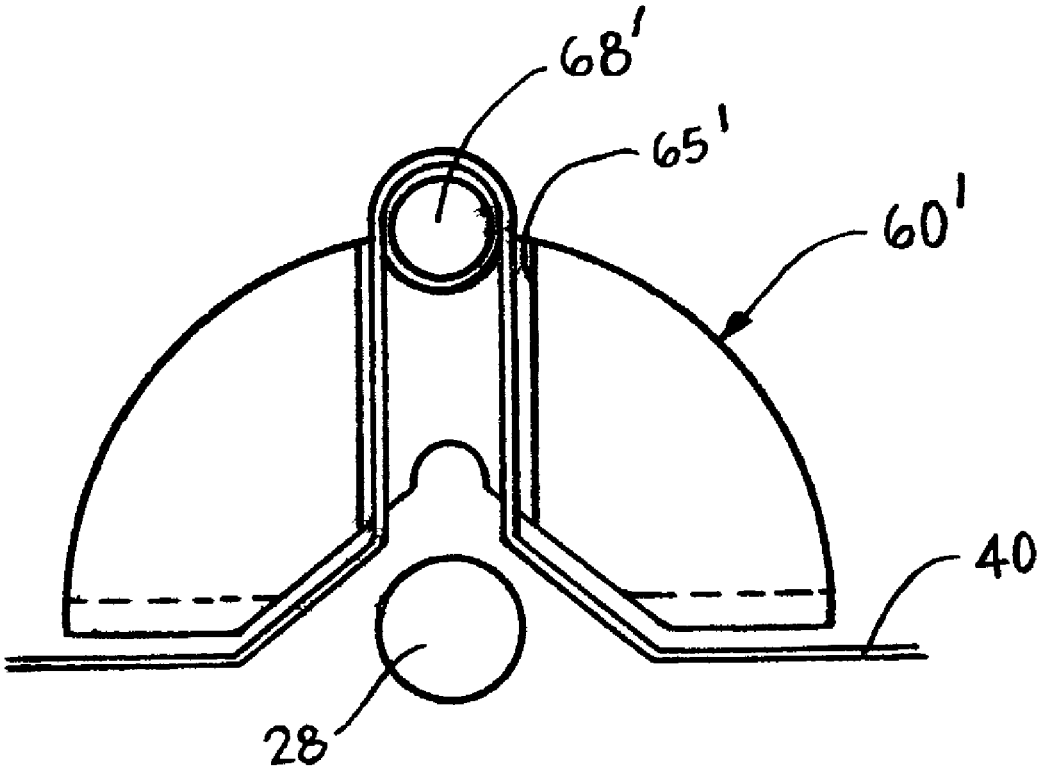
FIG. 4 is a detailed side view of the second level of a fourth embodiment of the cam arrangement which may be used with the compound bow of this present invention.

A fourth embodiment of the deflector cam used in the present invention is shown in FIG. 4 generally at 60'. In this embodiment, channel 65' takes the form of a slot through which cable 40 is inserted. Retention pin 68' (which is preferably grooved) is slipped vertically through the cable loop and is held in place by the tension in cable 40. While any of the disclosed embodiments could be used in a dual cam bow, it is this fourth embodiment that is shown in FIGS. 7A–C.

Figure 5B:
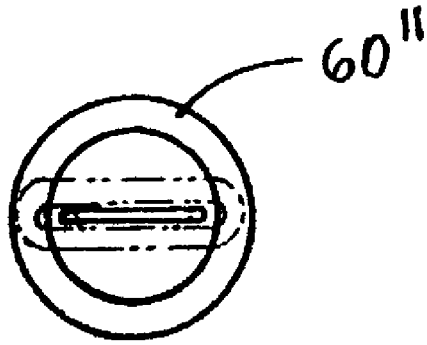
FIG. 5B is an end view of the second level of the fifth embodiment.
Figure 5A:
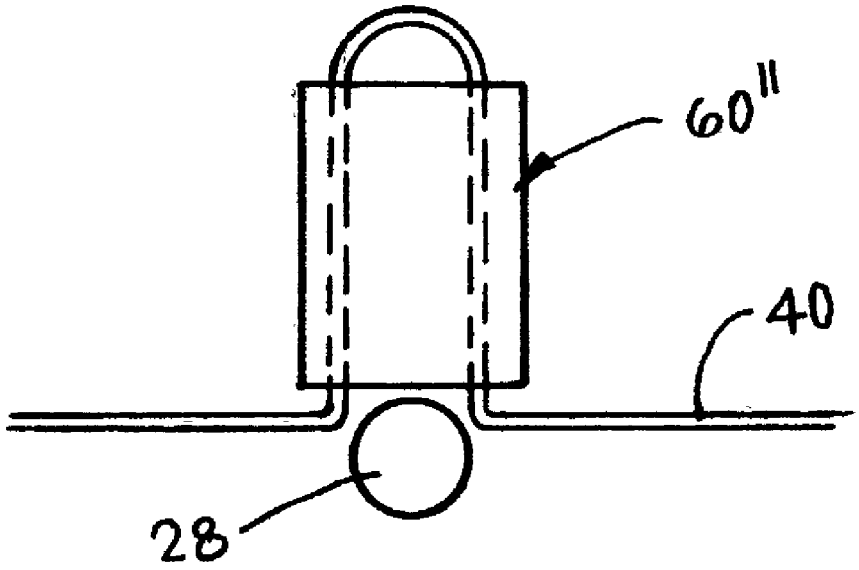
FIG. 5A is a detailed side view of the second level of a fifth embodiment of the cam arrangement of the present invention.

FIGS. 5A and 5B depict a fifth embodiment of the compound bow of the present invention showing a deflector cam useful in producing 100% let-off generally at 60". Deflector cam 60" comprises a cylinder through which cable 40 is pushed and then the cylinder is crimped or flattened as shown in dotted lines in FIG. 5B. In this way, cable 40 is captured and will be deflected along a line that effectively permits the force line to act through axle pin 28.

Figure 6A:
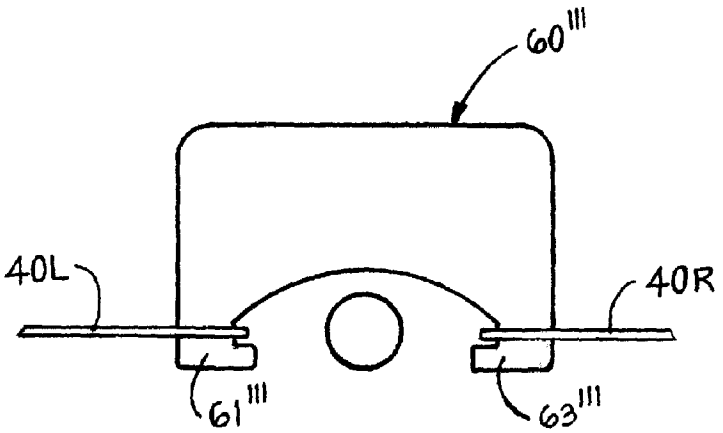
FIG. 6A is a side view of the second level of a sixth embodiment of the cam arrangement of the present invention.
Figure 6B:
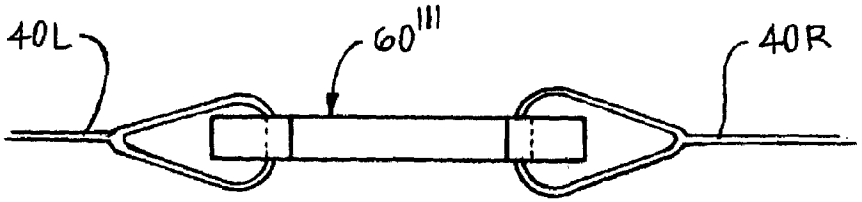
FIG. 6B is an edge view of the second level of the sixth embodiment.
Figure 6C:
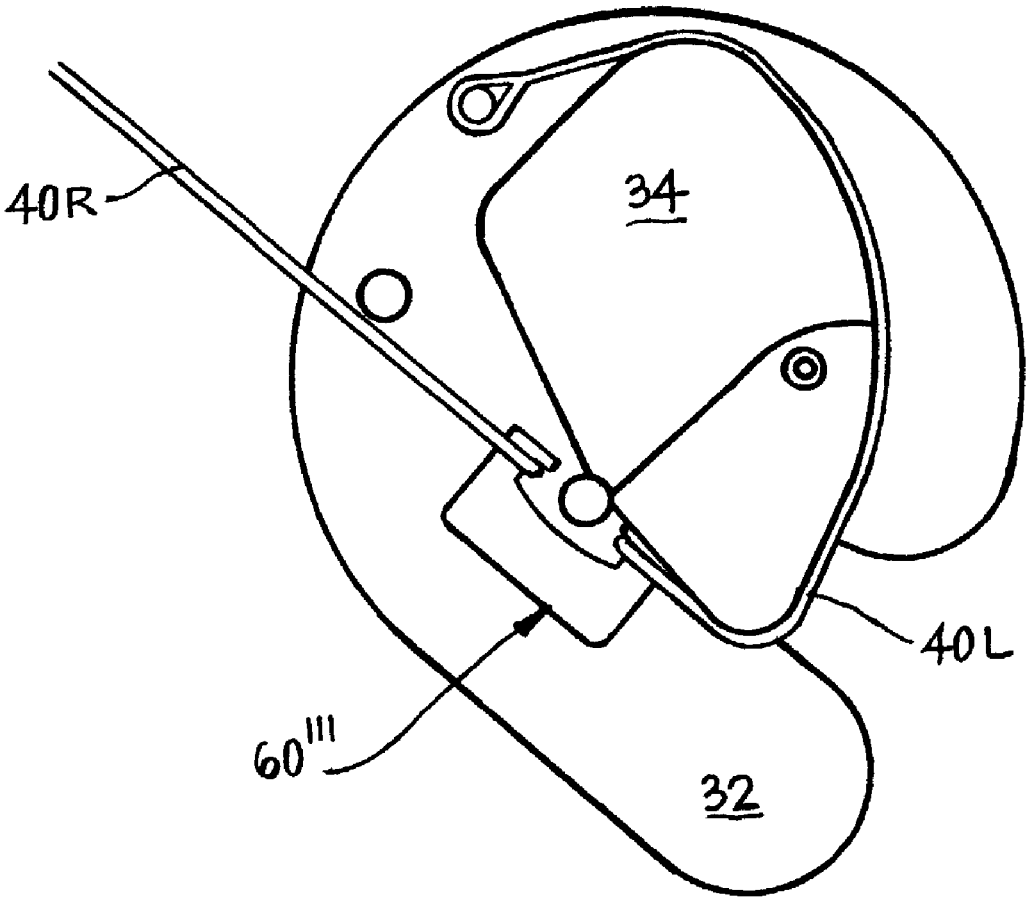
FIG. 6C is a side view of the sixth embodiment of the cam arrangement of the present invention.

A sixth embodiment producing an 100% let-off bow is shown as deflector in FIGS. 6A, 6B and 6C generally at 60'''. In this embodiment, deflector 60''' subdivides the cable into cable length 40L and 40R with the left cable portion 40L being tied off to ear 61''' and right cable portion 40R being tied off to ear 63'''. The gap between left cable portion 40L and right cable portion 40R achieves the effect of the force line of the harness cable acting through the axle pin 28 (FIG. 6C).

Figure 7A:
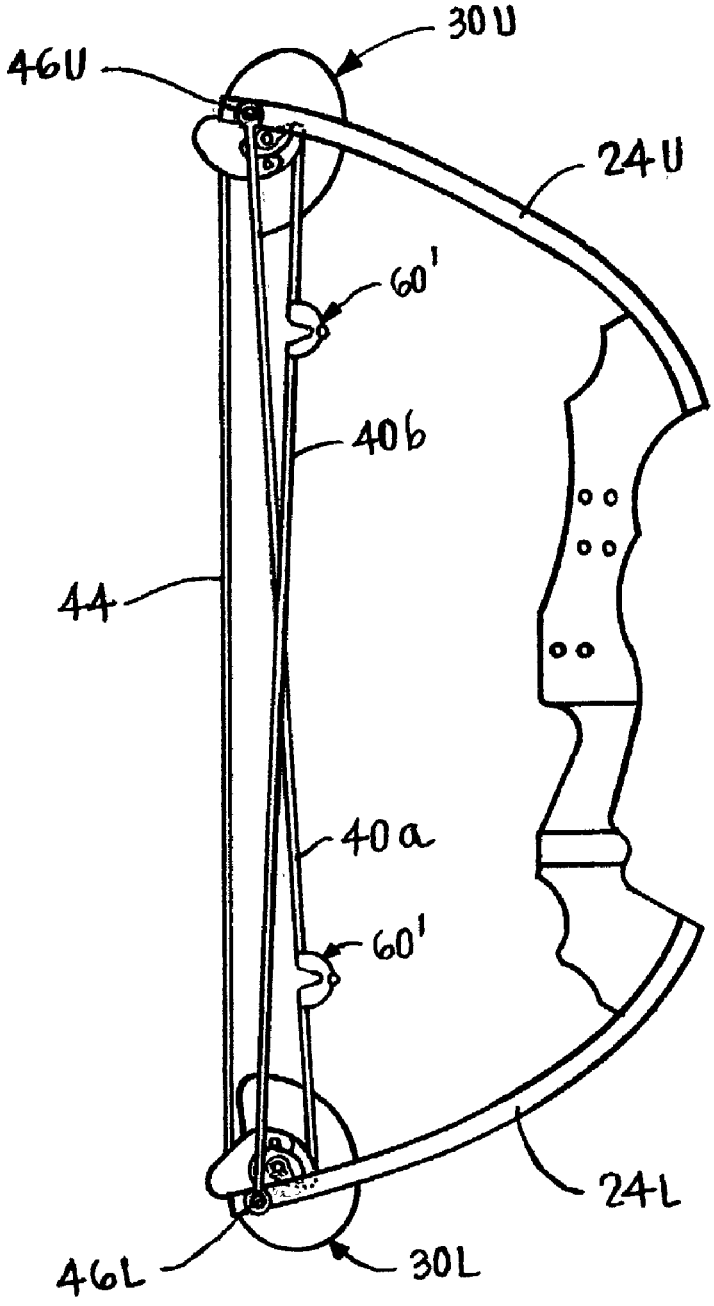
FIG. 7A is a side view of a seventh embodiment of the compound bow of the present invention showing a dual cam configuration at brace height position.
Figure 7B:
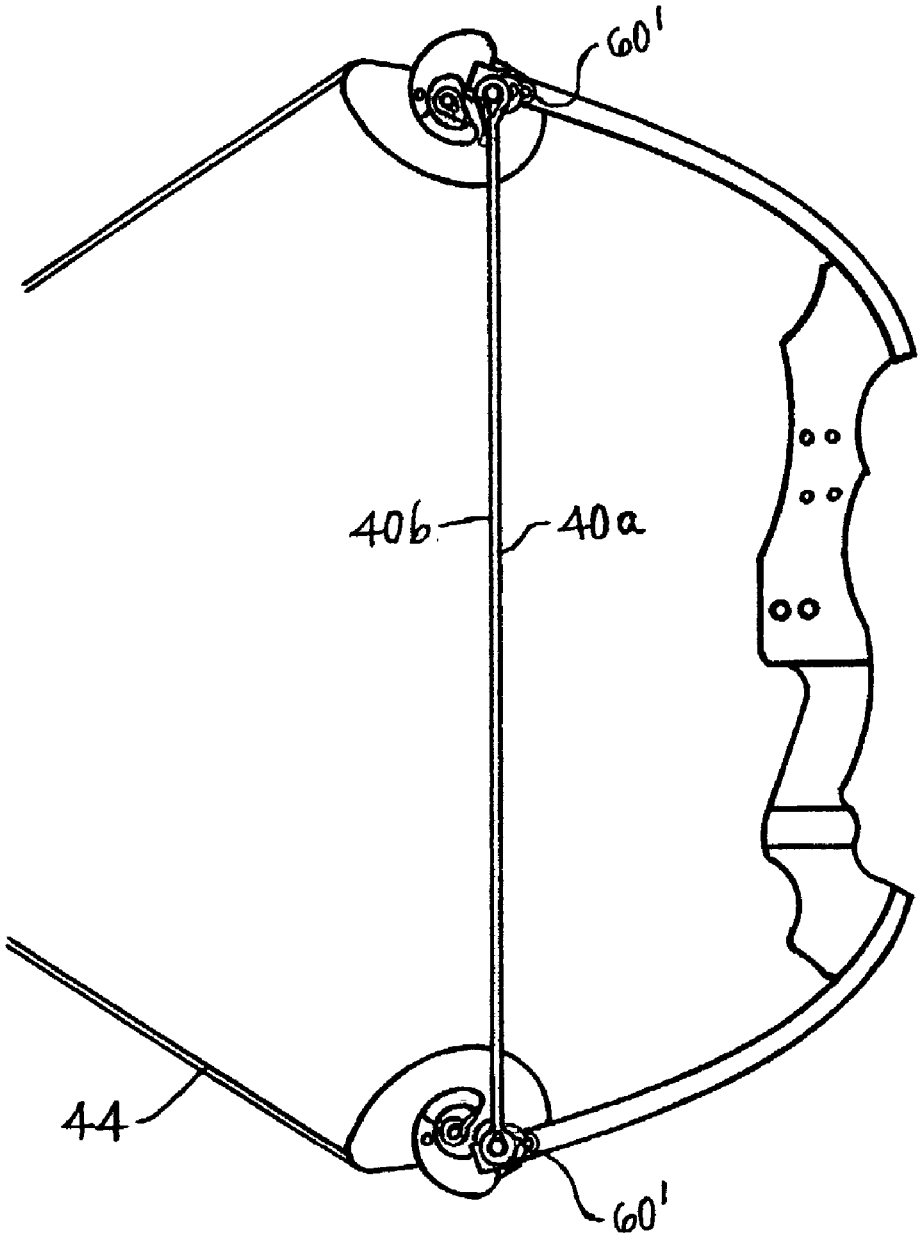
FIG. 7B is a side view of the seventh embodiment of the compound bow shown at full draw.
Figure 7C:
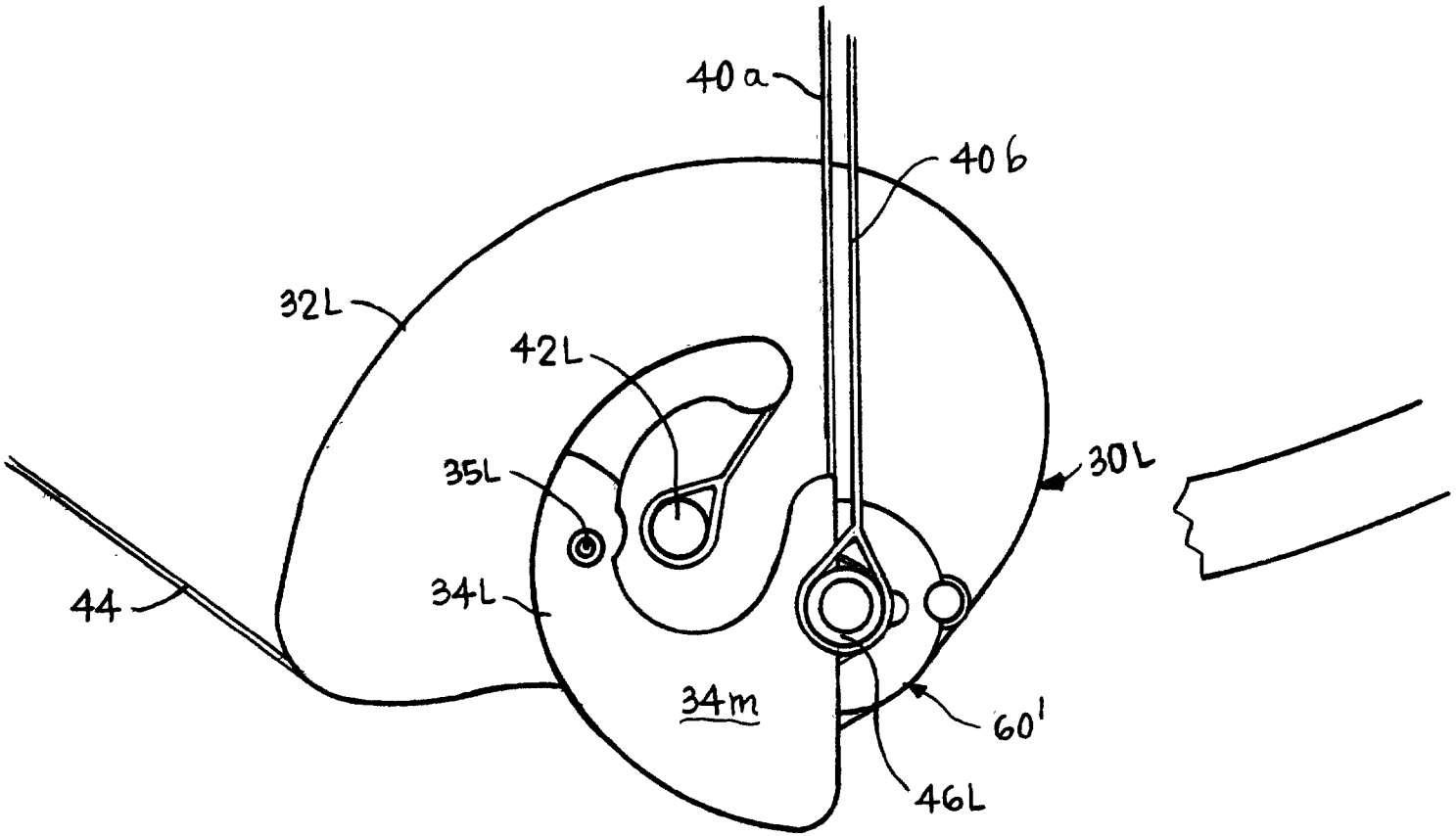
FIG. 7C is a detailed side view of the lower cam of the seventh embodiment.

A seventh embodiment of the 100% let-off bow of the present invention is shown in FIGS. 7A, 7B and 7C. This embodiment, as noted earlier, is a dual cam bow 20'. A first cam 30U is attached to upper limb 24U and a second mirror image cam 30L is attached to limb 24L. With a dual cam bow 20', there are only two cam portions: large cam portion 32 and cam portion 34. There are two harness cables: a first cable 40*a* attached to pin 46U, extending around cam portion 34L being anchored at its lower end by pin 42L; and a second cable 40*b* attached to pin 46L, extending around cam portion 34U being anchored at its upper end by pin 42U. In the dual cam configuration, there is no bushing for controlling let-off. Instead, the front portion 34*m* of cam 34 is modular and its shape will be altered to provide the desired amount of let-off.

The compound bow of the present invention enables an archer to adjust her/his bow to a let-off level with which she/he is comfortable in the range of between 85% and 99+%. This is achieved by permitting the force line of the harness cable to effectively act through the axle pin. It will be appreciated that an approximation of the benefits of the present invention could be achieved by allowing a portion of the cable diameter to act through the cable pin.

Various changes, alternatives and modifications will become apparent to one of ordinary skill in the art following a reading of the foregoing specification. For example, the invention includes a number of embodiments in which the cable is deflected around the pin and several in which portions of the pin are removed to accommodate the cable. Obviously, the pin could be bent, or otherwise deflected, to accommodate the cable without departing from the scope of the invention. It is intended that any such changes, alternatives and modifications as fall within the scope of the appended claims be considered part of the present invention.

I claim:

1. A compound archery bow comprising a) a riser;

b) a limb connected to said riser;

c) a first eccentric cam mounted on said limb;

d) cable means wrapped about at least a portion of said eccentric cam, said cable means having a force line and requiring a particular level of draw force and retaining force;

e) an axle pin mounting said cam to said limb and about which said cam rotates;

f) means to permit said force line of said cable means to effectively act through said axle pin enabling said cam to effect 100% let-off of said retaining force;

g) means to adjust said retaining force to a user desired level less than 100% let-off.

2. The compound bow of claim 1 wherein said means to permit said force line of said cable means to effectively act through said axle pin comprises a slot in said axle pin.

3. The compound bow of claim 1 wherein said means to permit said force line of said cable means to effectively act through said axle pin comprises a two piece axle pin, the two pieces being spaced by an amount adequate to accommodate a width of said cable means.

4. The compound bow of claim 1 wherein said means to permit said force line of said cable means to effectively act through said axle pin comprises means positioned to deflect said cable means around said axle pin.

5. The compound bow of claim 1 wherein said means positioned to deflect said cable means around said axle pin comprises a deflector plate having at least one recess for receiving a portion of said cable means.

6. The compound bow of claim 5 further comprising a pin for retaining said cable means in a deflected position where said cable means' force line effectively acts through said axle pin.

7. The compound bow of claim 5 wherein said deflector plate comprises a flattened tubular member which receives a portion of said cable means and then is crushed to retain said portion of said cable means therein.

8. The compound bow of claim 5 wherein said deflector plate comprises a first member having two recesses, one for ingress and a second for egress of said cable means, a protrusion for engaging/deflecting said cable means, and a retaining cover secured to said first member.

9. The compound bow of claim 1 wherein said means positioned to deflect said cable means around said axle pin comprises a connector plate having first and second arms, a first end of said cable means secured to said first arm and a second end of said cable means secured to said second arm.

10. The compound bow of claim 1 wherein said means to adjust said retaining force comprises means to deflect said cable means in a direction opposite to a direction of deflection caused by tension in said cable means.

11. The compound bow of claim 10 further comprising a second eccentric cam engaging a second portion of said cable means and said means to deflect said cable means comprises portions of said first and second eccentric cams.

12. The compound bow of claim 1 wherein said cable means whose force line effectively acts through said axle pin comprises a hamess cable.

13. A cam for a compound bow to enable said bow to be adjusted to 100% let-off, said cam comprising a) a first large diameter cam portion for engaging a first length of a draw cable, said draw cable requiring a particular level of draw force and retaining force;

b) a center cam portion for engaging a first length of a harness cable, said harness cable having a force line;

c) an axle pin mounting said cam to said bow and about which said cam rotates;

d) means to permit said force line of said harness cable to effectively act through said axle pin enabling said cam to effect 100% let-off of said retaining force.

14. The cam of claim 13 wherein said means to permit said force line of said harness cable to effectively act through said axle pin comprises a slot in said axle pin.

15. The cam of claim 13 wherein said means to permit said force line of said harness cable to effectively act through said axle pin comprises a two piece axle pin, the two pieces being spaced by an amount adequate to accommodate a width of said harness cable.

16. The cam of claim 13 wherein said means to permit said force line of said harness cable to effectively act through said axle pin comprises means positioned to deflect said harness cable around said axle pin.

17. The cam of claim 13 wherein said means positioned to deflect said harness cable around said axle pin comprises a deflector plate having at least one recess for receiving a portion of said harness cable.

18. The cam of claim 17 further comprising a pin for retaining said harness cable in a deflected position where said harness cable's force line effectively acts through said axle pin.

19. The cam of claim 17 wherein deflector plate comprises a flattened tubular member which receives a portion of said hamess cable and then is crushed to retain said portion of said harness cable therein.

20. The cam of claim 17 wherein said deflector plate comprises a first member having two recesses, one for ingress and a second for egress of said harness cable, a protrusion for engaging/deflecting said hamess cable, and a retaining cover secured to said first member.

21. The cam of claim 13 wherein said means positioned to deflect said harness cable around said axle pin comprises a connector plate having first and second arms, a first end of said hamess cable secured to said first arm and a second end of said hamess cable secured to said second arm.

22. The cam of claim 13 further comprising means to adjust said retaining force including means to deflect said hamess cable in a direction opposite to a direction of deflection caused by tension in said harness cable.

23. The cam of claim 22 further comprising a second eccentric cam engaging a second portion of said harness cable and said means to deflect said harness cable in a direction opposite comprises portions of said first and second eccentric cams.

24. A compound archery bow comprising e) a riser;

f) a limb connected to said riser;

g) a first eccentric cam mounted on said limb;

h) cable means wrapped about at least a portion of said eccentric cam, said cable means having a force line and requiring a particular level of draw force and retaining force;

i) an axle pin mounting said cam to said limb and about which said cam rotates;

j) means to permit a peripheral portion of said cable means to effectively act through said axle pin;

k) means to adjust said retaining force to a user desired level.

* * * * *